United States Patent [19]

Daming

[11] Patent Number: 4,671,353

[45] Date of Patent: Jun. 9, 1987

[54] APPARATUS FOR RELEASING A CEMENTING PLUG

[75] Inventor: Kenneth W. Daming, St. Charles, Mo.

[73] Assignee: Halliburton Company, Duncan, Okla.

[21] Appl. No.: 816,178

[22] Filed: Jan. 6, 1986

[51] Int. Cl.[4] ..... E21B 33/05

[52] U.S. Cl. ..... 166/70; 166/80; 166/87; 251/73; 92/21 MR

[58] Field of Search ..... 166/69, 70, 72, 80, 166/86, 87, 88, 91; 251/73, 94; 92/21 R, 21 MR, 24, 27, 28

[56] References Cited

U.S. PATENT DOCUMENTS

| | | | |
|---|---|---|---|
| 3,322,197 | 5/1967 | Baker et al. | 166/70 |
| 4,392,556 | 7/1983 | Deutsch | 92/21 MR |
| 4,574,882 | 3/1986 | Szarka | 166/70 |

FOREIGN PATENT DOCUMENTS

| | | | |
|---|---|---|---|
| 0001284 | 1/1977 | Japan | 92/27 |
| 2036835 | 7/1980 | United Kingdom | 166/70 |

*Primary Examiner*—James A. Leppink
*Assistant Examiner*—Terry Lee Melius
*Attorney, Agent, or Firm*—James R. Duzan

[57] ABSTRACT

Apparatus for releasing a cementing plug. A first cylinder mounted on a plug container includes a plunger received therein which is longitudinally moveable into the plug container for supporting a cementing plug. A second cylinder received over the first cylinder defines an annular chamber between the cylinders. An annular sleeve is sealingly and slidingly received within the chamber and is slidable between a first position toward the plug container and a second position away from the plug container. The first cylinder includes a slot formed in one side thereof and the plunger includes a recess formed on the radially outer surface thereof. A lock dog is received in the slot and is urged into the plunger recess when the annular sleeve is in the first sleeve position and is withdrawn from the recess when the annular sleeve is in the second sleeve position.

13 Claims, 6 Drawing Figures

APPARATUS FOR RELEASING A CEMENTING PLUG

The instant invention relates to well cementing apparatus and more particularly to such apparatus for releasing a cementing plug.

In cementing casing in a well bore, it is necessary to use plugs beneath and above cement slurry as it is pumped down the casing in order to separate the slurry from well fluids and/or drilling mud which may be present in the well. Various prior art devices are used to release the plug at the top of the casing which extends from the well bore when cement slurry is pumped into the casing. One such device is that shown in U.S. Pat. No. 3,322,197 to Baker and assigned to assignee of the instant application.

The Baker apparatus comprises a cylinder mounted on the radially outer surface of a plug container and includes a plunger which extends into the container for supporting a cementing plug therein. The plunger may be retracted into the cylinder thereby releasing the plug into the casing.

The Baker apparatus suffers from several disadvantages, one of which is the manner in which it may be manually operated to release the plug. The Baker apparatus includes a pair of handles that extend radially outwardly from the cylinder which may be pushed toward the plug container to release the cementing plug. The cementing plug container may be as much as thirty feet above the drilling rig floor and it has been discovered that pulling the handles away from the plug container would be an easier and less hazardous manner in which to manually release the cementing plug. Further, the Baker apparatus includes an exposed spring which is therefore subject to damage. After the plunger of the Baker apparatus is retracted, it may only be extended by manually pushing the plunger back into the plug container. Due to the relative sizes of an internal piston and the plunger of the Baker apparatus, it requires hydraulic, as opposed to pneumatic, fluidic control. If the pressure in the plug container is at a high level, the internal piston in the Baker apparatus which is used to retract the plunger under hydraulic pressure is subject to damage when it slams against the outer end of the cylinder.

The instant invention comprises a first cylinder mountable on a plug container. A plunger is received within the first cylinder and is longitudinally moveable into the plug container for supporting the cementing plug. A second cylinder is received over the first cylinder and an annular chamber is defined between the cylinders. An annular sleeve received within the annular chamber is slidable between a first position toward the plug container and a second position away from the plug container when the first cylinder is mounted on the plug container. A slot is formed in one side of the first cylinder and a recess is formed on the radially outer surface of the plunger. A dog received in the slot is urged into the plunger recess when the annular sleeve is in its first position and is withdrawn from the recess when the annular sleeve is in its second position.

The instant invention overcomes the above-enumerated disadantages of prior art apparatus. These and other advantages of the instant invention will become more fully apparent when the detailed description is read in view of the accompanying drawings, wherein.

DETAILED DESCRIPTION OF THE PREFERRED EMBODIMENT OF THE INVENTION

Figure 1:
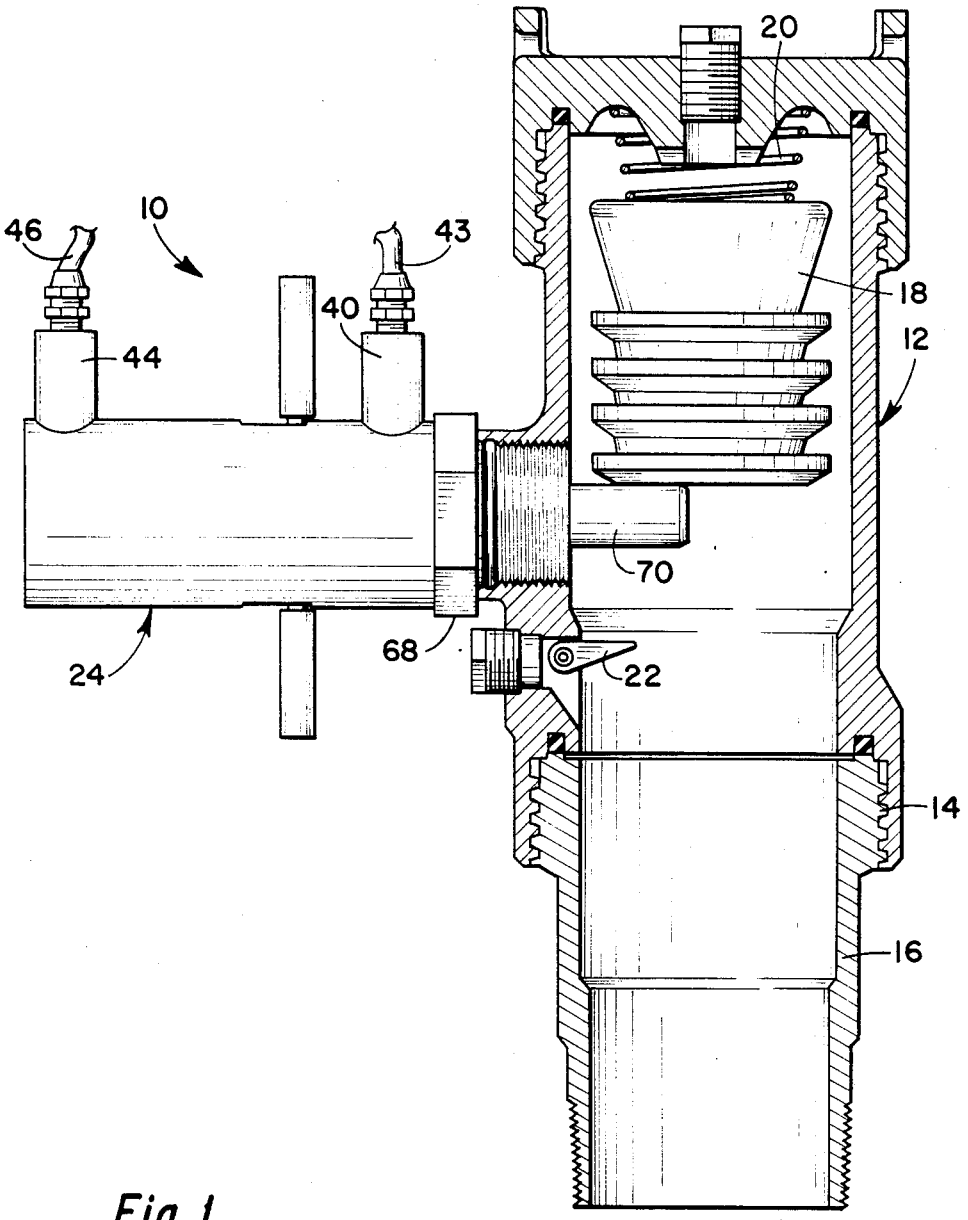
FIG. 1 is a cross-sectional view of a cementing plug container having the apparatus of the instant invention mounted thereon.

Indicated generally at 10 is apparatus constructed in accordance with the instant invention. Apparatus 10 is mounted on a conventional plug container 12. Container 12 is engaged via threads 14 to the upper end 16 of a string of casing which extends from a well bore. Upper end 16 extends above the floor of a drilling rig. In some cases, upper end 16 may extend above the floor by as much as 30 feet.

A conventional cementing plug 18 is received in plug container 12 and is urged downwardly by a spring 20. Downward movement of plug 18 is restrained by apparatus 10 of the instant invention. An indicator lever 22 is mounted on the plug container for indicating whether the plug has passed from container 12.

Figure 2:
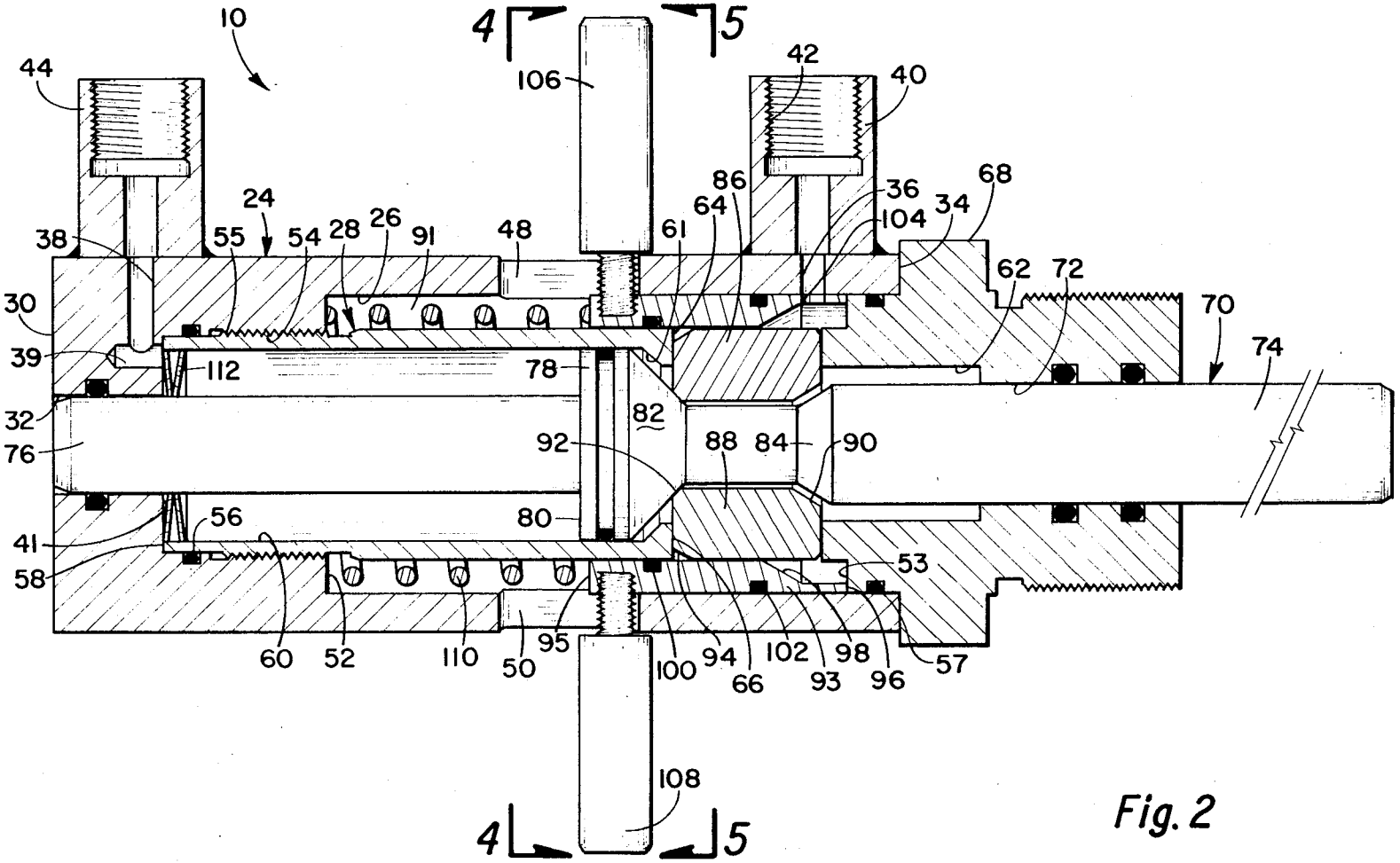
FIG. 2 is a cross-sectional view of apparatus constructed in accordance with the instant invention having the plunger extended.

Considering now FIGS. 1 and 2, apparatus 10 includes therein a body 24, such being also referred to herein as a second cylinder. Body 24 includes a longitudinal bore 26 therein into which a mandrel 28, such being also referred to herein as a first cylinder, is received.

Body 24 includes an outer end 30, such having a bore 32 therethrough, and an opposing inner end 34.

Body 24 further includes a fluid inlet port 36 and a fluid outlet port 38. Port 36 is in fluid communication with an inlet hose coupling 40 having a threaded bore 42 therein for threadably receiving a hose 43 which is connected to a conventional fluidic power supply (not shown). Outlet port 38 includes an outlet hose coupling 44, such being similar in construction to inlet hose coupling 40, for threadably receiving a hose 46 (in FIG. 1) which is connected to the fluidic power supply.

In the instant embodiment of the invention, the fluidic power supply is a source of pressurized air which is commonly found on drilling rigs. The pressurized air may be selectively supplied to either of hoses 43, 46. If necessary or desired, a source of pressurized hydraulic fluid may be used instead of a pressurized air source.

Fluid outlet port 38 includes a portion 39 which is in fluid communication with an end 41 of bore 26.

Figures 4, 5, 6:
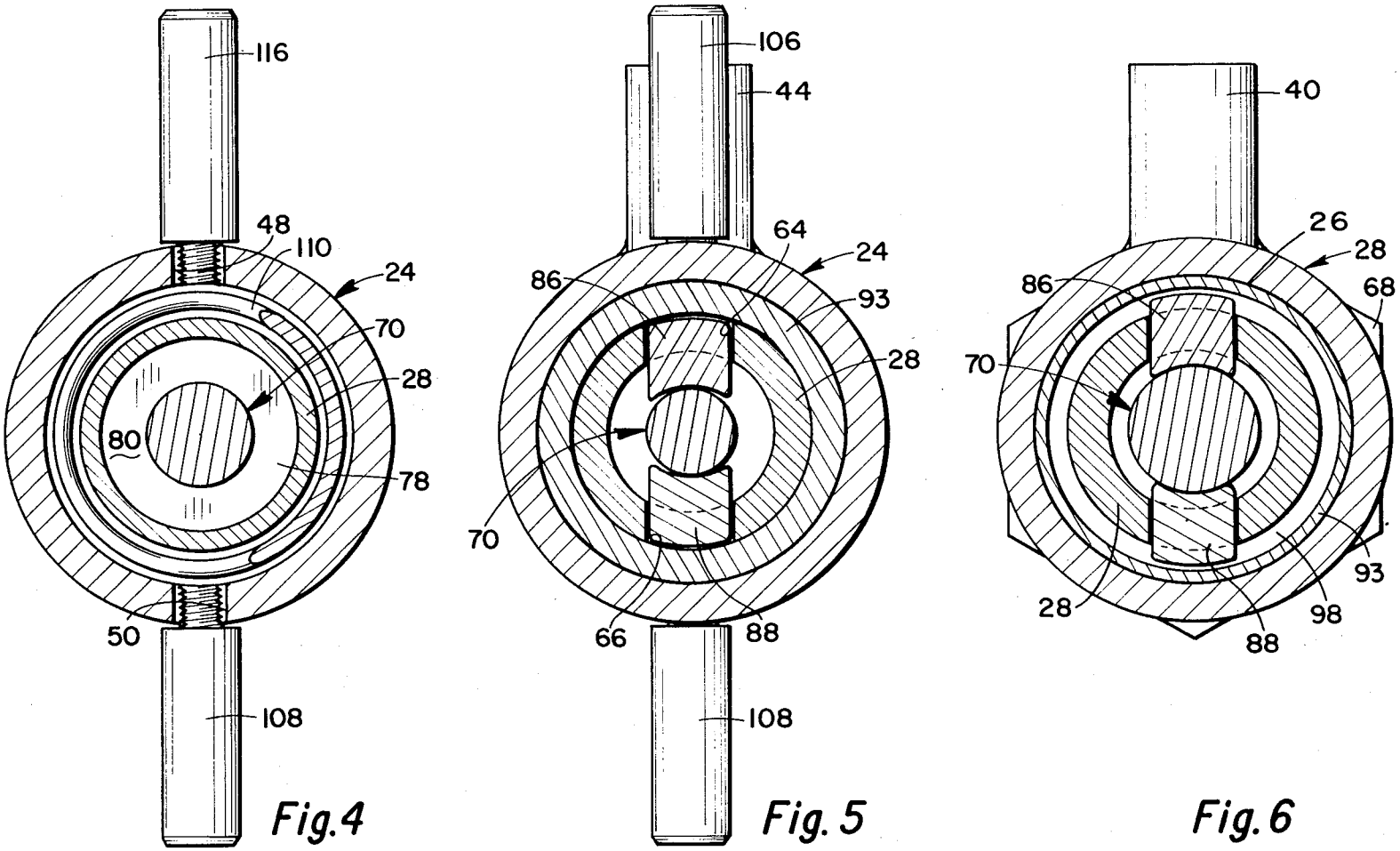
FIG. 4 is a cross-sectional view taken along line 4—4 in FIG. 2.
FIG. 5 is a cross-sectional view taken along line 5—5 in FIG. 2.
FIG. 6 is a cross-sectional view taken along line 6—6 in FIG. 3.

A pair of opposing longitudinal slots 48, 50, such also being viewable in FIG. 4, are included in body 24.

Body 24 includes a pair of opposing annular shoulders, 52, 53 and a set of threads 54 formed on the radially inner surface thereof which are threadably engaged with threads 55 on the radially outer surface of mandrel 28. O-rings 56, 57 seal between the radially inner surface of the body and the radially outer surface of the mandrel at either end thereof.

Mandrel 28 includes an outer end 58 having a bore 60 therein. A tapered shoulder 61 defines a passageway between bore 60 and a counterbore 62 in the mandrel. Counterbore 62 includes therein a pair of opposing longitudinal slots 64, 66, such being also viewable in FIG. 5. Slots 64, 66 permit fluid communication between the interior and exterior of the mandrel.

A hexagonal flange 68 is provided to facilitate threading of apparatus 10 into a bore provided in plug container 12 as shown in FIG. 1.

A plunger 70 is slidingly and sealingly received within a bore 72 in mandrel 28. Plunger 70 includes an inner end 74 which is extendable into plug container 12 and an outer end 76 which is received in bore 32. The plunger includes a piston 78 fixidly mounted thereon which is sealingly and slidingly received within bore 60. Piston 78 includes a first end 80 having a surface transverse to the longitudinal axis of the plunger and a second end 82 having a tapered surface as shown. A tapered surface 84 opposite second end 82 defines therebetween a plunger recess.

A pair of opposing lock dogs 86, 88 are received at least partially within opposing slots 64, 66. In the configuration of apparatus 10 shown in FIG. 2, a portion of each lock dog extends into counterbore 62 and into the plunger recess. Dog 88 includes tapered surfaces 90, 92, 94. Dog 86 is substantially identical to dog 88 and includes similar tapered portions as shown.

An annular chamber 91 is defined between bore 26, the radially outer surface of mandrel 28, and shoulders 52, 53 on the mandrel. Included within annular chamber 91 is an annular sleeve or piston 93. Piston 93 includes a pair of opposing ends 95, 96, with end 96 being abutted against shoulder 53 in the view of FIG. 2. A counterbore 98 communicates with end 96. An O-ring 100 seals between the radially inner surface of the piston and the radially outer surface of mandrel 28 while an O-ring 102 seals between the radially outer surface of the piston and bore 26. A radial bore 104 provides an opening for fluid communication between fluid inlet port 36 and the interior of the mandrel to the right of piston 78 via slots 64, 66.

A pair of opposing handles 106, 108 extend radially outwardly from piston 93 and are threadably connected thereto via radial threaded bores as shown. A helical spring 110 is compressed between shoulder 52 and end 95 of the piston within annular chamber 91 and biases the piston toward shoulder 53.

A conventional hydraulic spring 112 is abutted against end 41 which, as will later become more fully apparant, cushions the impact of end 80 of piston 78 against end 41. Spring 112 is also referred to herein as shock absorbing means.

In operation, apparatus 10 is mounted on plug container 12 as shown in FIG. 1. In the configuration of FIGS. 1 and 2, end 74 of plunger 70 supports plug 18 (in FIG. 1). In such a configuration, plunger 70 and piston 78 are each in what is referred to herein as a first position.

Figure 3:
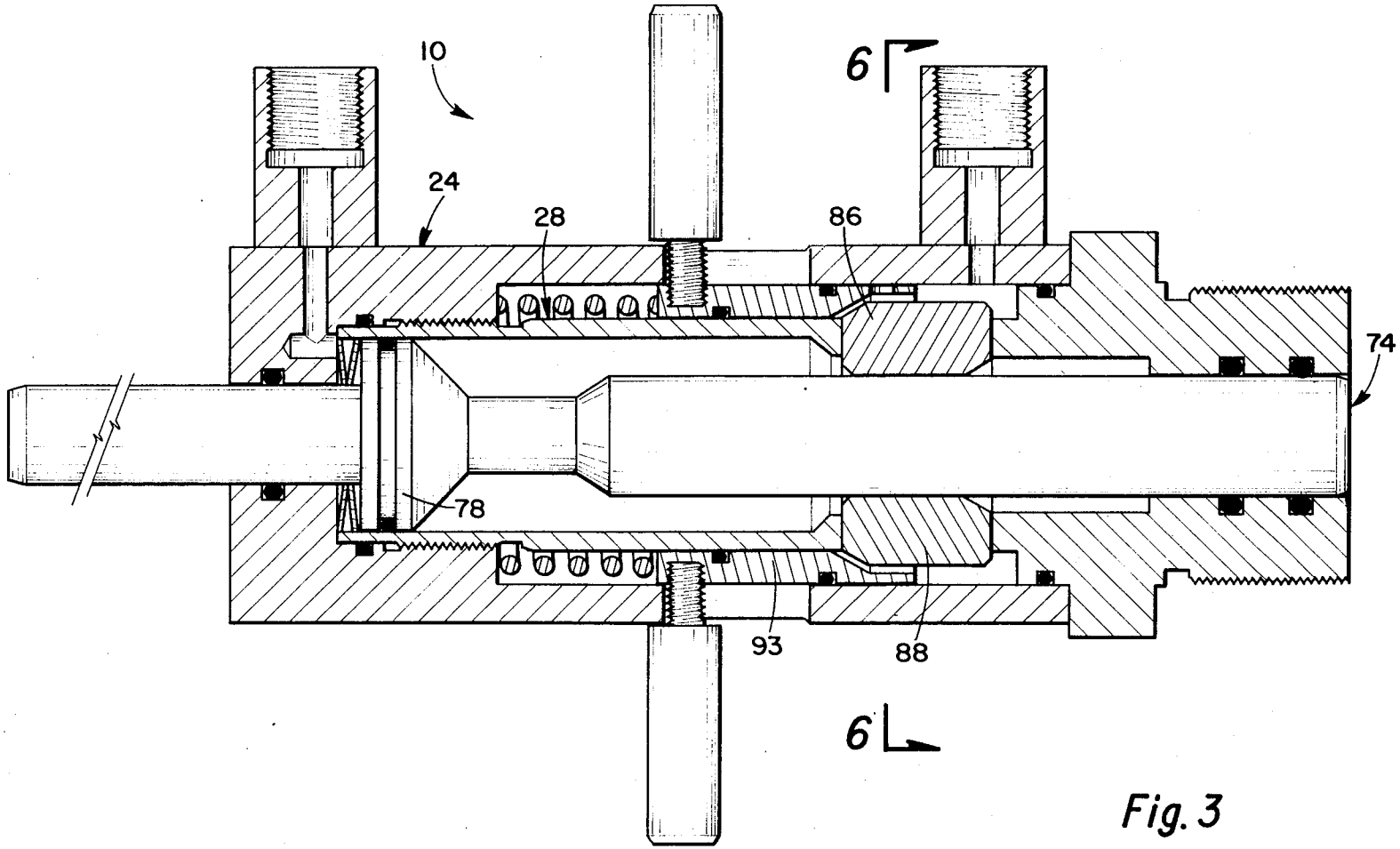
FIG. 3 is a view similar to FIG. 2 with the plunger contracted.

At an appropriate time, plunger 70 is retracted so that the apparatus assumes the configuration of FIG. 3 thus permitting plug 18 to fall in the casing. When it is desired to cause the plunger to contract, pressurized air is provided to hose 43. The air pressure acts through port 36 against piston 93 thus urging the piston to the left as viewed in FIG. 2. When the counterbore 98 of the piston is adjacent tapered surface 94 of dog 88 and adjacent the corresponding tapered surface of dog 86), air pressure acting against piston 93 urges each of the dogs outwardly due to the action of taperd surface 84 against surface 90 on dog 88 (and against the corresponding surface on the other dog).

When annular piston 93 is in the position of FIG. 3, referred to herein as a second position, dogs 86, 88 have been urged, as described above, radially outwardly until inner end 74 of plunger 70 is received between the dogs as shown in FIG. 3. At this point, air pressure acting against piston 78 drives the plunger to the position of FIG. 3, such being referred to herein as a second plunger position, thus permitting plug 14 to drop.

In the event that it is necessary or desirable to manually cause plunger 70 to retract to permit the plug to drop, such can be achieved by gripping handles 106, 108 and moving them until the handles are in the position of FIG. 3. Such action moves piston 93 leftwardly and permits the dogs to be withdrawn from the piston recess as described above. Often the interior of the casing is under pressure and such pressure acts against the right most end of plunger 70 thus causing the plunger to move to the configuration of FIG. 3 after such leftward movement of poston 93. Sometimes the casing pressure is so high that the plunger is driven suddenly and forceably to the configuration of FIG. 3. When such occurs, spring 112 acts as a shock absorber to prevent damage to the apparatus.

The apparatus may be changed from the configuration of FIG. 3 to that of FIGS. 1 and 2 by applying air pressure via hose 46 to port 38. Such pressure acts against end 80 of piston 78 thus urging plunger 70 to the right. When the plunger recess is adjacent dogs 86, 88, the biasing action of spring 110 urges piston 93 rightwardly. Counterbore 98 acts against tapered surface 94 on lock dog 88, (and against the corresponding tapered surface on the other dog) thus urging the dogs into the plunger recess and permitting the apparatus to assume the configuration of FIGS. 1 and 2.

In the event that it is necessary or desirable to manually change the apparatus from the configuration of FIG. 3 to that of FIGS. 1 and 2, plunger end 76 may be pushed to the right, as viewed in FIG. 3 until the apparatus assumes the configuration of FIGS. 1 and 2 due to the action of piston 93 against the dogs 86 and 88.

It is to be appreciated that additions and modifications to the instant embodiment of the invention may be made without departing from the spirit thereof which is defined in the following claims.

I claim:

1. Apparatus for releasing a cementing plug from a plug container comprising:

a first cylinder mountable on said plug container;

a plunger received within said first cylinder and being longitudinally moveable into said plug container for supporting a cementing plug;

a second cylinder received over said first cylinder and defining an annular chamber therebetween, said second cylinder including a slot therein;

an annular sleeve sealingly received within said annular chamber and being slidable between a first position toward said plug container and a second position away from said plug container when said first cylinder is so mounted, said annular sleeve including a handle extending radially outwardly therefrom, said handle extending through said second cylinder slot;

a slot formed in a side of said first cylinder;

a recess formed on the radially outer surface of said plunger;

a dog received in said slot, said dog being urged into said plunger recess when said annular sleeve is in said first position and being withdrawn from said recess when said annular sleeve is in said second position; and a spring received in said annular chamber for biasing said annular sleeve into said first position.

2. The apparatus of claim 1 wherein said apparatus further includes:

a piston mounted on said plunger and being sealingly engaged with the bore of said first cylinder; and a fluid conduit communicating with one side of said piston for driving said plunger to a position for supporting a cementing plug in said plug container when said first cylinder is so mounted.

3. The apparatus of claim 2 wherein said apparatus further includes shock absorbing means disposed between said piston and the end of said cylinder.

4. The apparatus of claim 2 wherein the ratio of the cross-sectional area of said piston to said plunger is at least 2.5:1.

5. Apparatus for releasing a cementing plug from a plug container comprising:

a first cylinder having a set of radially outer threads formed adjacent one end thereof;

a flange mounted on the other end of said first cylinder for mounting said cylinder on said plug container;

a second cylinder having a set of radially inner threads found adjacent one end thereof, said second cylinder threads being threadably engaged with said first cylinder threads, said second cylinder further having the other end thereof abutted against said flange;

a plunger received within said first cylinder and being longitudinally moveable relative to said first cylinder;

an annular chamber defined between said first and second cylinders;

an annular sleeve received within said annular chamber and being longitudinally slidable therein, the first longitudinal position of said annular sleeve being adjacent the end of said annular chamber toward said flange and the second longitudinal position of said annular sleeve being spaced away from said first longitudinal position toward the other end of said annular chamber, said annular chamber including:

a first portion between one end of said annular sleeve and the other end of said annular chamber, said first portion containing biasing means for biasing said sleeve toward said first longitudinal position; and a second portion between the other end of said annular sleeve and the end of said annular chamber toward said flange, said second portion being sealed from said first portion for permitting movement of said sleeve from said first longitudinal position toward said second longitudinal position by introducing fluid into said second chamber portion;

a slot formed in a side of said first cylinder;

a recess formed on the radially outer surface of said plunger; and a dog received in said slot, said dog being urged into said plunger recess when said annular sleeve is in a first longitudinal position and being receivable within said annular chamber when said annular sleeve is in a second longitudinal position.

6. The apparatus of claim 5 wherein said second cylinder includes a slot therein and wherein said annular sleeve includes a handle extending radially outwardly therefrom, said handle extending through said second cylinder slot for permitting manual movement of said sleeve from said first longitudinal position toward said second longitudinal position.

7. The apparatus of claim 5 wherein said apparatus further includes a piston mounted on said plunger and being sealingly engaged with the bore of said first cylinder, said second chamber portion being in fluid communication with the interior of said first cylinder through said first cylinder slot.

8. The apparatus of claim 7 wherein said apparatus further includes a fluid conduit in communication with the end of said first cylinder bore adjacent said first cylinder threads for driving said piston from a position abutting said first cylinder bore end toward said dogs by introducing fluid into said conduit.

9. Apparatus for releasing a cementing plug from a plug container, said apparatus in operative condition comprising:

a first cylinder mounted on said plug container and extending radially outwardly therefrom, said first cylinder having an open outer end;

a piston received within the bore of said first cylinder and being slidable between a first position toward said plug container and a second position at the outer end of said first cylinder;

a plunger fixedly mounted on said piston and being moved thereby between a first position in which said plunger extends into said container for supporting a cementing plug and a second position in which said plunger is withdrawn from said plug container;

a second cylinder received over said first cylinder, said second cylinder having an outer end with a bore therethrough through which said plunger is sealingly received, said second cylinder including a slot therein;

a seal formed between the radially outer surface of said first cylinder and the radially inner surface of said second cylinder adjacent each end thereof;

an annular chamber defined between the radially outer surface of said first cylinder and the radially inner surface of said second cylinder;

an annular sleeve received within said chamber and being slidable between a first position toward said plug container and a second position away from said plug container, said annular sleeve including a handle extending radially outwardly therefrom through said second cylinder slot, said slot being of a length to just permit said annular sleeve to move between said first and second annular sleeve positions;

means for biasing said sleeve toward said first position;

a first conduit in fluid communication with said annular chamber between one end of said sleeve and the end of said chamber toward said plug container;

a second fluid conduit formed in said second cylinder outer end and being in fluid communication with the radially outer end of said first cylinder bore;

a slot formed in a side of said first cylinder, said slot being adjacent said annular sleeve when it is in said first annular sleeve position;

a recess formed on the radially outer surface of said plunger, said recess being adjacent said slot when said plunger is in said first plunger position; and a dog received in slot, said dog being urged into said plunger recess when said annular sleeve is in said first annular sleeve position and being withdrawn from said recess when said annular sleeve is in said second annular sleeve position.

10. The apparatus of claim 9 wherein said annular sleeve is sealed between the radially outer surface thereof and the radially inner surface of said second cylinder and wherein said annular seal is further sealed between the radially inner surface thereof and the outer surface of said first cylinder, said annular sleeve being moveable from said first annular sleeve position toward said second annular sleeve position by introducing fluid into said first fluid conduit.

11. The apparatus of claim 9 wherein said apparatus further includes shock absorbing means disposed between said piston and said second cylinder outer end.

12. The apparatus of claim 9 wherein said means for biasing said sleeve towards said first position comprises a spring received within said annular chamber, said spring having one end urged against said annular sleeve and the other end urged against the radially outer end of said annular chamber.

13. The apparatus of claim 9 wherein said first cylinder includes a flange mounted on the radially inner end thereof for mounting said first cylinder on said plug container and wherein the radially inner end of said second cylinder abuts against said flange.

* * * * *